US005977501A

United States Patent [19]

Werkheiser et al.

[11] Patent Number: 5,977,501

[45] Date of Patent: Nov. 2, 1999

[54] SORTATION AND SEQUENCING SYSTEM

[75] Inventors: James Werkheiser, Nazareth; Phillip N. Ross, Hellertown; David A. Clark, Nazareth; Robert Porter, Bath, all of Pa.

[73] Assignee: SI Handling Systems, Inc., Easton, Pa.

[21] Appl. No.: 08/764,950

[22] Filed: Dec. 13, 1996

[51] Int. Cl.[6] ..... B07C 209/583

[52] U.S. Cl. ..... 209/583; 209/555; 209/558; 209/584; 209/592; 209/593; 209/594; 209/595; 209/596; 209/651; 209/654; 209/917; 209/923; 209/942

[58] Field of Search ..... 209/555, 558, 209/583, 584, 592–596, 651, 654, 917, 923, 942

[56] References Cited

U.S. PATENT DOCUMENTS

| | | | |
|---|---|---|---|
| 3,643,798 | 2/1972 | Krupotich | 209/593 |
| 3,757,939 | 9/1973 | Henig | 209/584 |
| 4,479,187 | 10/1984 | Nara | 209/584 X |
| 4,501,528 | 2/1985 | Knapp | 414/273 |
| 4,567,988 | 2/1986 | Weibel | 209/583 X |
| 4,627,540 | 12/1986 | Takeda | 209/555 |
| 4,907,699 | 3/1990 | Butcher et al. | 209/583 X |
| 4,963,251 | 10/1990 | Bohm et al. | 209/584 X |
| 5,119,954 | 6/1992 | Svyatsky et al. | 209/584 |
| 5,271,703 | 12/1993 | Lindqvist et al. | 414/268 |
| 5,459,670 | 10/1995 | Johnson et al. | 209/584 X |

FOREIGN PATENT DOCUMENTS

| | | | |
|---|---|---|---|
| 572830 | 12/1993 | European Pat. Off. | 209/583 |
| 2620054 | 3/1989 | France | 209/651 |

*Primary Examiner*—Donald P. Walsh
*Assistant Examiner*—Brett Martin
*Attorney, Agent, or Firm*—Seidel, Gonda, Lavorgna & Monaco, PC

[57] ABSTRACT

A sortation and sequencing system for sorting a plurality of different items into discrete orders and putting the items into a predetermined sequence within each discrete order or group of orders. The system includes an induction station for accepting items in random succession, and a sensor at the induction station for sensing an identifying characteristic unique to each item and for generating tracking signals uniquely corresponding to the items for tracking the items through the system. A controller receives the tracking signals and generates sort command and sequence command signals which are in part responsive to the tracking signals. A sorter receives the items from the induction station and directs individual items to selected ones of a plurality of sort locations, each sort location corresponding to an individual order or group of orders, in response to sort command signals from the controller. A sequencer associated with each sort location receives sorted items from the sorter and discharges the items in a preselected sequence at a discharge location in response to the sequence control signals.

14 Claims, 7 Drawing Sheets

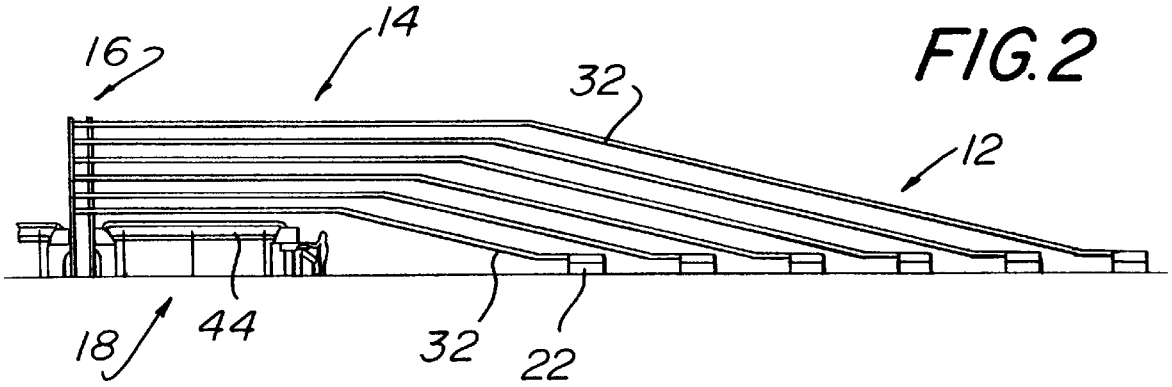
FIG.2
FIG.5
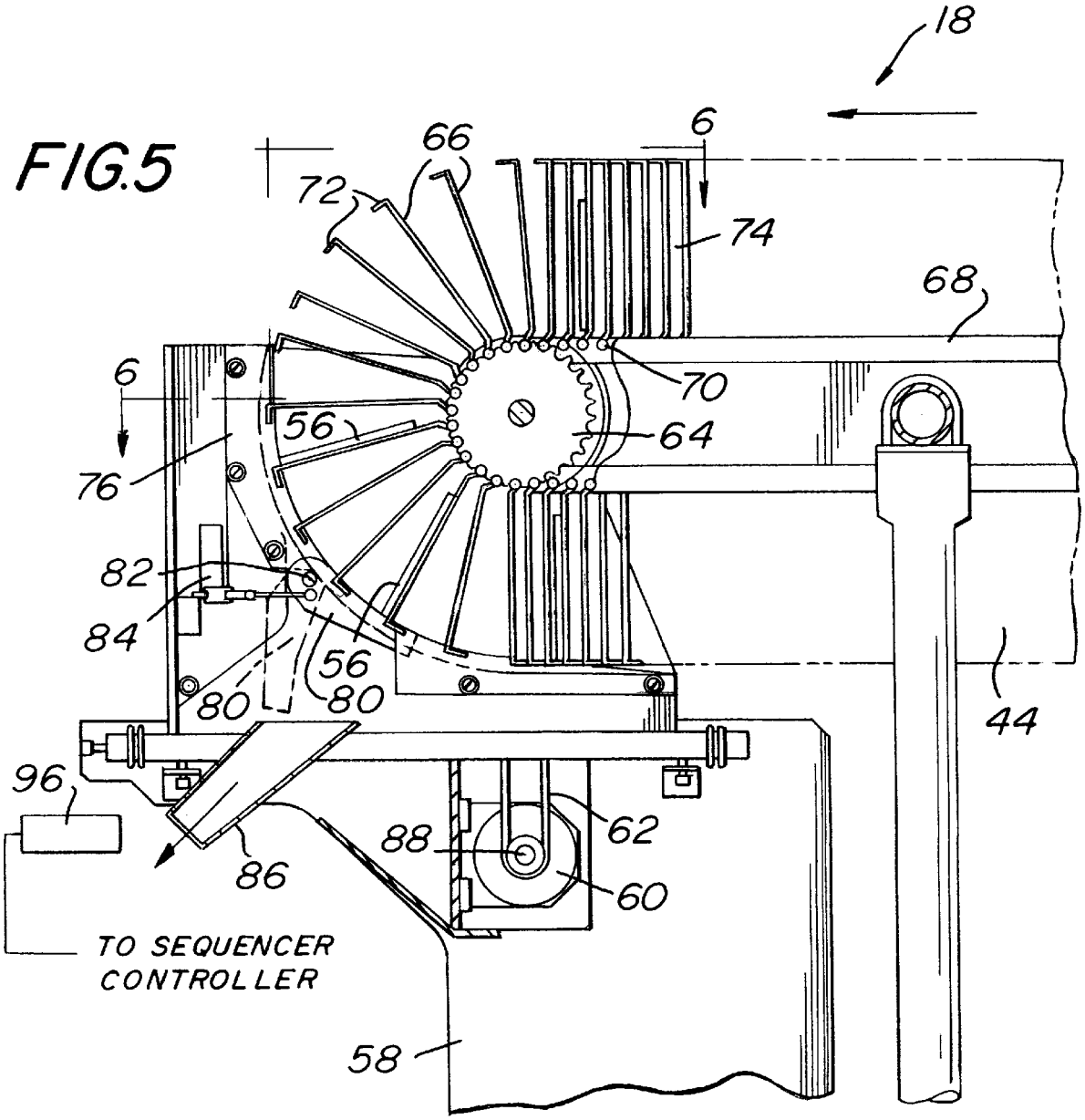

SCS
20
ORDER NO. AND
SEQUENCE NO.
SEQUENCER
CONTROLLER
90
SEQUENCER
POSITION
ENCODER
88
SEQUENCER
DRIVE
60
PRODUCT
SENSORS AND
DISCHARGE
CONTROL
SEQUENCER
HOME POSITION
SENSOR
92

SORTATION AND SEQUENCING SYSTEM

FIELD OF THE INVENTION

The present invention relates to systems for automatically sorting different items into orders or groups of orders consisting of a plurality of items and for automatically putting the different items into a preselected sequence within each order.

BACKGROUND OF THE INVENTION

Systems for sorting different items into orders are known. For example, U.S. Pats. No. 4,501,528 and 5,271,703 disclose systems which automatically pick items from designated storage locations and deposit them on a moving belt in groups of items corresponding to discrete orders. These patents are concerned with grouping items into an order, but are not concerned with also putting grouped items into a preselected sequence within the order. Moreover, the systems disclosed in these patents do not address the problem of taking a random succession of different items and not only grouping the randomly arranged items into orders but also putting the items into a preselected sequence within an order.

Thus, prior to the present invention, the items sorted into orders were not put into any particular sequence within an order. It was sufficient just to assemble the various items comprising an order and collect them all in the same location. There is a need, however, for not only sorting multiple items into an order, but also for putting the sorted items in a defined sequence within the order. For example, greeting cards sold at retail outlets are typically arranged on display racks in predetermined locations. Cards are received from a supplier in bundles, with each bundle being coded for placement at a particular predetermined location in the display racks. When a retail greeting card outlet places an order for greeting cards to replenish its inventory, it is desired that the order arrive with bundles of greeting cards being already arranged in a predetermined sequence, corresponding to the sequence in which the cards are displayed on the display racks, rather than with the bundles of cards being arranged randomly within a shipping container. Arranging the bundles of cards in the shipping container in the predetermined sequence enables the retail outlet to restock its display racks very efficiently. To restock, all a clerk needs to do is open the shipping container and move along the display racks in one direction, removing the card bundles from the shipping container in sequence and placing the cards on the display racks in the defined sequence as he goes.

The present invention provides a system that not only collects a plurality of different items, such as bundles of greeting cards, into an order corresponding to a particular retail location, but also arranges the bundles in a predetermined sequence within the order.

SUMMARY OF THE INVENTION

The present invention is directed to a sortation and sequencing system for sorting a plurality of different items into discrete orders or groups of orders and putting the items into a predetermined sequence within each discrete order. The system includes an induction station for accepting items in random succession, and a sensor at the induction station for sensing an identifying characteristic unique to each item and for generating tracking signals uniquely corresponding to the items for tracking the items through the system. A controller receives the tracking signals and generates sort command and sequence command signals which are in part responsive to the tracking signals. A sorter receives the items from the induction station and directs individual items to selected ones of a plurality of sort locations, each sort location corresponding to an individual order, in response to sort command signals from the controller. A sequencer associated with each sort location receives sorted items from the sorter and discharges the items in a preselected sequence at a discharge location in response to the sequence control signals.

The invention also includes a method of sorting a plurality of different items into discrete orders or groups of orders and putting the items into a predetermined sequence within each discrete order. The method comprises the steps of accepting items in random succession at an induction station, sensing at the induction station an identifying characteristic unique to each item and generating tracking signals uniquely corresponding to the items for tracking the items through the system, generating sort command and sequence command signals in part responsive to the tracking signals, conveying the items from the induction station to a sorter for directing individual items to selected ones of a plurality of sort locations, each sort location corresponding to an individual order, in response to sort command signals from the controller, and conveying sorted items from the sorter into a sequencer associated with each sort location and for discharging the items in a preselected sequence at a discharge location in response to the sequence control signals.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 2 is a side elevational view of the product scanning and weighing portion of the system according to the invention, taken along the lines 2—2 in FIG. 1.

FIG. 5 is a side elevational view, partially in section, showing the discharge end of the sequencing portion of the system according to the invention.

DESCRIPTION OF THE INVENTION

Figure 1:
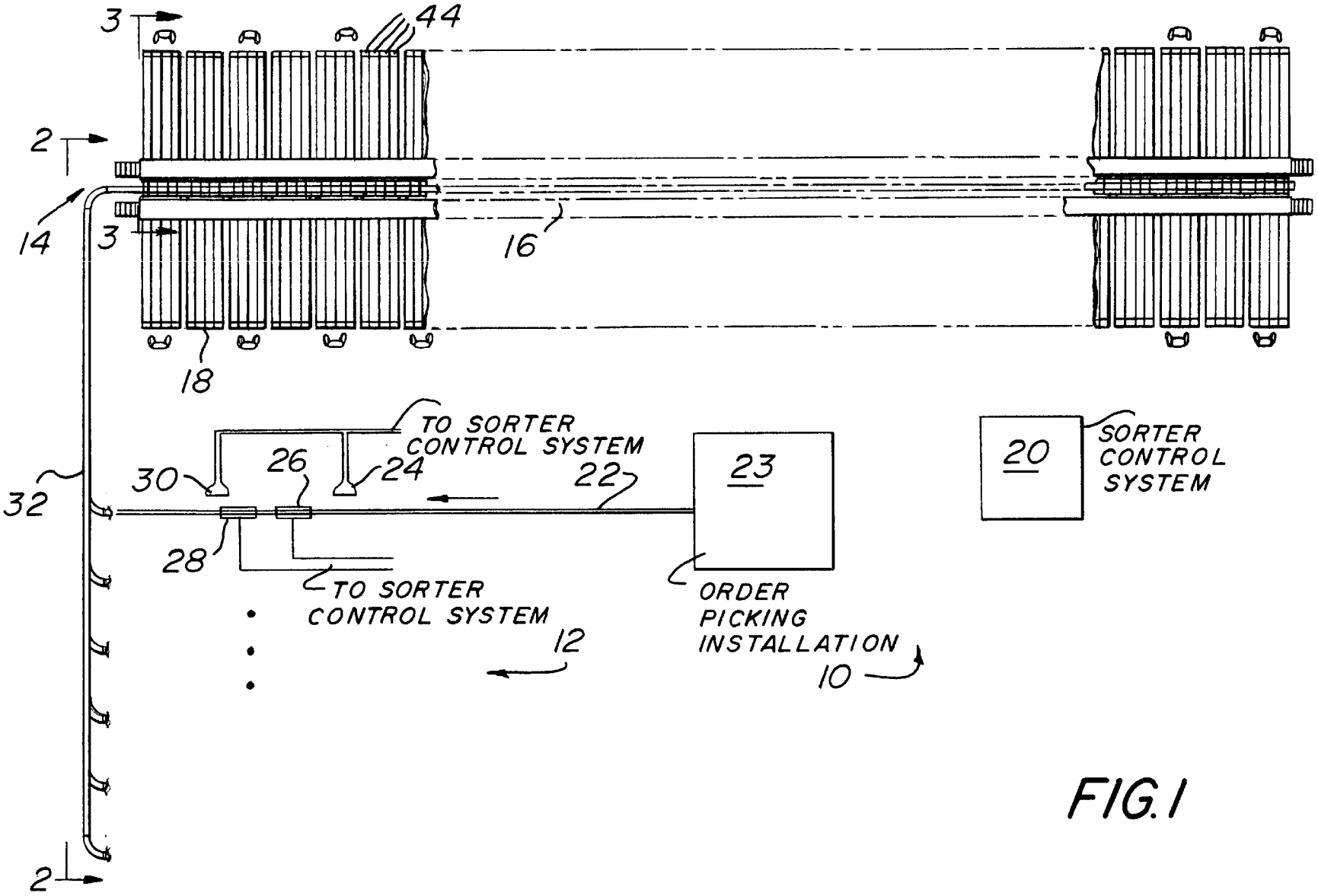
FIG. 1 is a top plan view, greatly simplified, showing the major parts of the sortation and sequencing system according to the present invention.

Referring now to the drawings, wherein like numerals indicate like elements, there is shown in FIG. 1 a sortation and sequencing system 10 according to the present invention. Sortation and sequencing system 10 comprises a scanning and weighing section 12, an induction area 14, a sortation portion 16, and a sequencing portion 18. Sortation and sequencing system 10 also includes a sorter control system 20, which receives sensor inputs from sensors (described more fully hereinafter) associated with the sortation and sequencing system 10 and generates control signal outputs in response to the sensor inputs.

Scanning and weighing section 12 comprises a plurality of conveyors 22 which receive, in random order, items to be sorted and sequenced. (For ease of illustration, only one conveyor and its associated sensors, to be described, is shown in detail. Six conveyors are indicated generally in FIG. 1, but it will be appreciated that any number of conveyors can be used without departing from the invention.) The items are picked from inventory at an order picking installation 23 and delivered to scanning and weighing section in random order. As illustrated in FIG. 1, conveyors 22 move individual items from right to left. As items are moved by one of the conveyors 22, they first pass a photosensor 24, which may be referred to as the "entry photo-eye," which generates a signal to the sorter control system, referred to as the "SCS," 20. The signal from the entry photo-eye 24, which indicates the presence of an item on conveyor 22, informs the SCS 20 that items are being introduced into sortation and sequencing system 10. In response to the signal from the entry photo-eye 24, SCS 20 enables a "weigh-in-motion" scale 26 associated with conveyor 22, which determines the weight of an item as the item passes over it. Those skilled in the art will understand how a "weigh-in-motion" scale can be constructed, and therefore it need not be described in detail here. It could, to mention just one example, comprises a strain gauge which is subjected to deflection by the conveyor 22 as the item passes over it. In any case, the exact structure of the scale 26 is not crucial to the invention. Scale 26 generates item weight signals representative of the weights of individual items which pass over it.

Immediately downstream from scale 26 is an omnidirectional bar code reader 28. Bar code reader 28 is located to read bar codes which have previously been placed on individual items. Bar code reader 28 may, but need not necessarily, be placed above conveyor 22. The bar codes on individual items provide individual item identification data, which is read by bar code reader 28 and converted into an item identification signal.

Immediately downstream from the bar code reader 28 is a second photosensor 30, which may be referred to as the "transmit photo-eye." Transmit photo-eye 30 detects when an item has moved past the bar code reader 28, and generates a transmit signal when it does so. The transmit signal is used to combine the item weight signal and the item identification signal for a given item and transfer the combined signal to SCS 20.

After passing transmit photo-eye 30, individual items move from conveyor 22 onto an induction conveyor 32, which conveys the items to sortation portion 16. As best seen in FIG. 2, individual induction conveyors may be located on inclines one above another, so that the paths of the items to be sorted and sequenced are stacked one above another. This enables sortation and sequencing system 10 to make efficient use of available floor space. As illustrated in FIG. 2, six induction conveyors 32 are stacked, although the invention is not limited to any specific number of conveyors or item paths.

Figure 3:
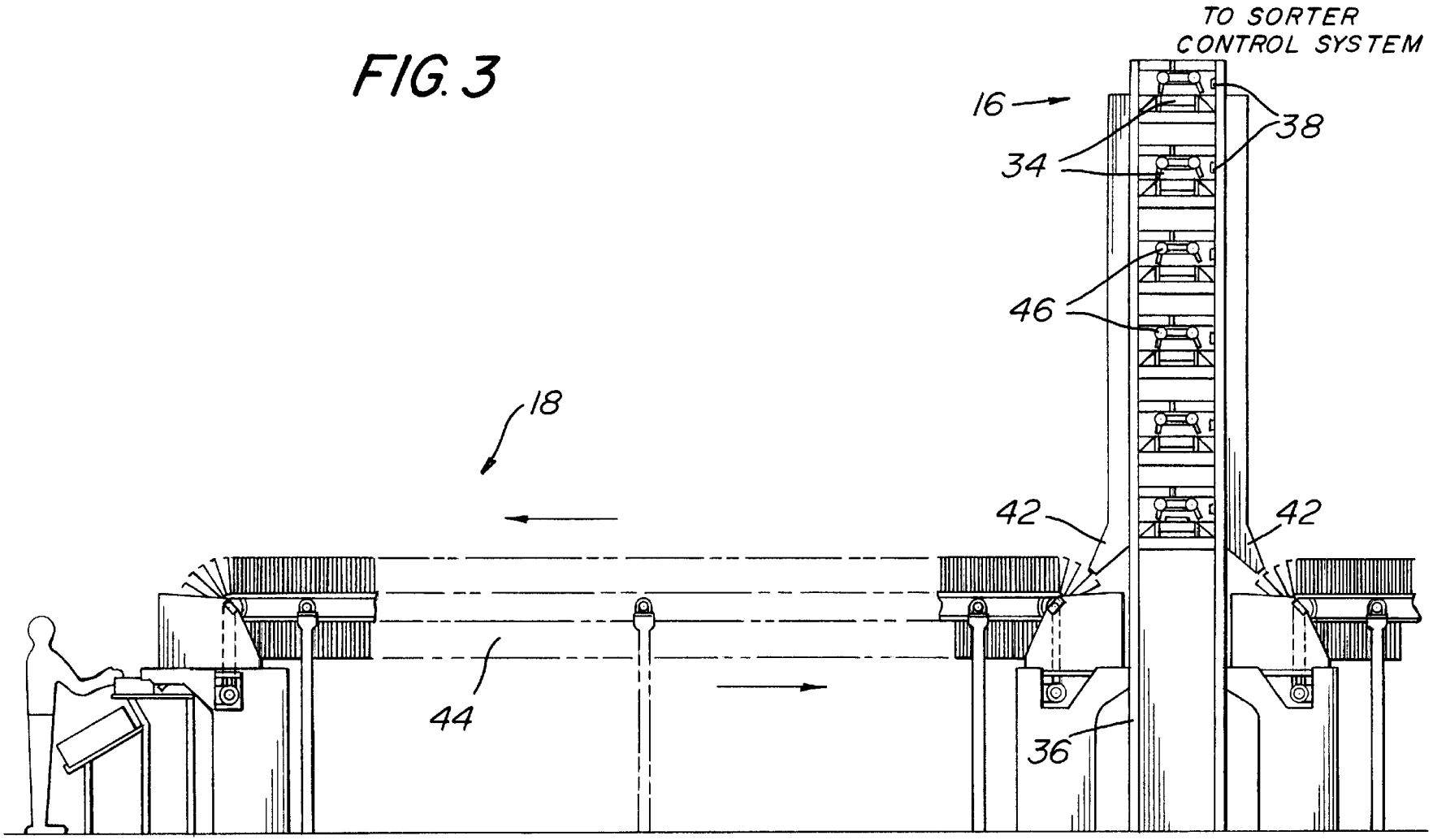
FIG. 3 is a side elevational view, on a larger scale, of the sortation portion and the sequencing portion of the system according to the invention, taken along the lines 3—3 in FIG. 1.

From the induction conveyors 32, items enter the sortation portion 16. As best seen in FIG. 3, sortation portion 16 comprises a plurality (six are illustrated) of sortation conveyors 34, stacked one above another in a frame 36. One either side of frame 36 are a plurality of sequencer conveyors, which make up sequencing portion 18 and which will be described in detail hereinafter. Each sortation conveyor 34 is preferably equipped with a shaft encoder (not shown), in known manner, which generates encoder pulses which are representative of the conveyor speed. At the entry end of each sortation conveyor 34 is a photosensor 38, referred to as the "sorter photo-eye." As an item moves from an induction conveyor 32 to a sortation conveyor 34, it passes the sorter photo-eye 38, which generates an item location signal to the SCS 20. The item location signal can be made to include information regarding the length of the item. For example, a light beam received by sorter photo-eye 38 can be interrupted by an item as it passes the sorter photo-eye 38. Alternatively, the sorter photo-eye can respond to light energy reflected from an item. This can be used to sense when the leading edge and the trailing edge of the item pass a given point. If the linear speed of the sortation conveyor 34 is known, the number of encoder pulses counted during the interval between the time the leading edge of the item is sensed and the time the trailing edge is sensed by sorter photo-eye 38 can be used along with the known conveyor speed to calculate the length of the item.

Figure 4:
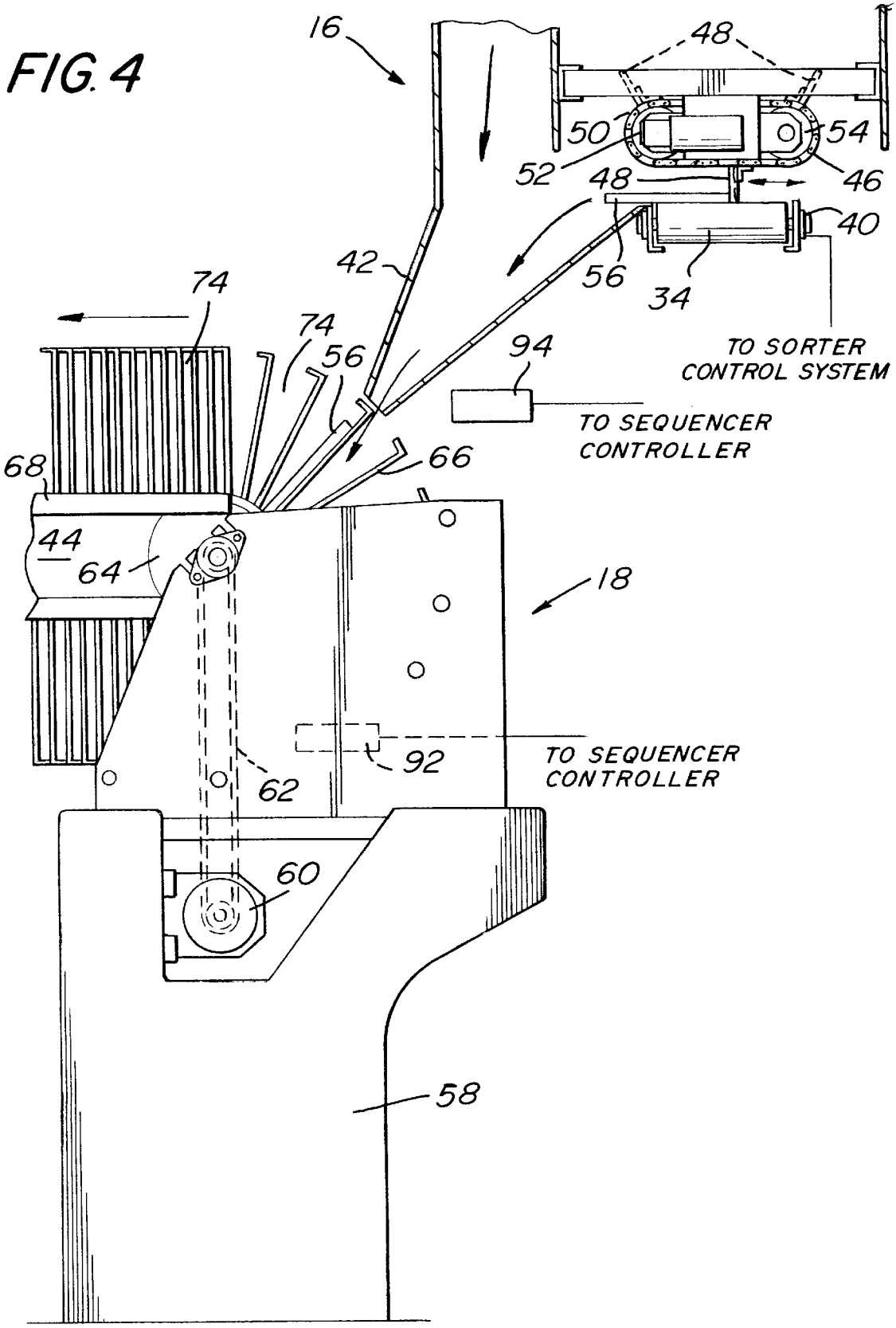
FIG. 4 is a side elevational view, partially in section, showing the relationship between the discharge end of the sortation portion and the receiving end of the sequencing portion of the system according to the invention.

The speed of the sortation conveyors is sensed by individual encoders 40, best seen in FIG. 4. An encoder 40 can be attached to a shaft of each sortation conveyor 34 to derive a pulse output signal representative of conveyor movement and speed, in known manner.

The item location signal from sorter photo-eye is sent to SCS 20, where is it is used to confirm the presence of the item on the sortation conveyor based on the information gathered by the bar code reader 28 associated with conveyor 22. The item location signal and the output signal from the encoder 40 are used by the SCS to pinpoint the exact location of the item on the sortation conveyor. From this information, the SCS also calculates the center of the item for sortation purposes, so that the sortation diverters, described hereinafter, will be commanded to push the item off the sortation conveyor at the center, rather than an edge, of the item.

Figure 7:
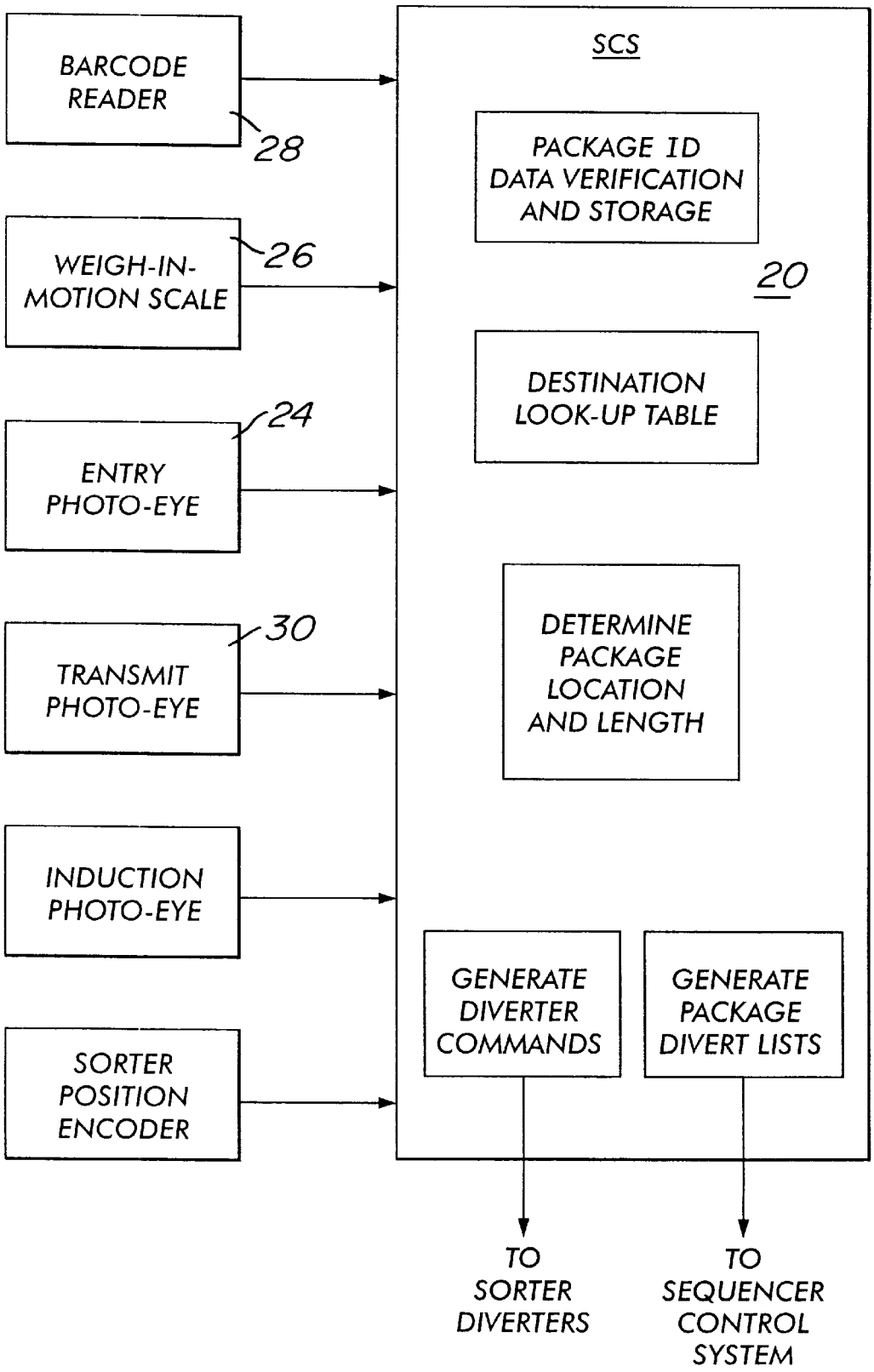
FIG. 7 is a block diagram, greatly simplified, showing the operation of the sorter control system to control the operation of the sortation portion of the system according to the invention.

After individual items enter the sortation portion 16, they are conveyed by sortation conveyors 34 from left to right, as illustrated in FIG. 1, or away from the viewer as illustrated in FIG. 3. As they do so, they pass a plurality of sorting chutes 42 on both sides of the sortation conveyors 34. There is one sorting chute 42 for each sequencing conveyor in sequencing portion 18. Each sequencing conveyor is assigned an individual order, and all individual items which make up that order are diverted from one of the sortation conveyors into the appropriate sequencing conveyor. When the item location and the encoder output signals, as processed by SCS 20, indicate that an item on one of the sortation conveyors 34 is approaching the proper position to be diverted into a corresponding sequencing conveyor, a diverter command signal is generated by SCS 20 and sent to the proper diverter to divert the item from the sortation conveyor and into the discharge chute associated with the corresponding sequencing conveyor when the item reaches the proper position to be diverted. The functional operation of SCS 20 and its associated inputs and outputs is shown in simplified form in FIG. 7.

As best seen in FIG. 1, there are a plurality of individual sequencing conveyors 44 arranged along both sides of the sortation conveyors 34. For ease of operation and maintenance, the sequencing conveyors 44 are illustrated as arranged in groups of four, but any number of sequencing conveyors and any number of conveyors within a group may be employed without departing from the invention. As already noted, there is a sorting chute 42 associated with each sequencing conveyor 44, and each sorting chute 42 can receive items from each of the six stacked sortation conveyors. Each sortation conveyor 34 has associated with it a plurality of diverters 46. One diverter is provided adjacent each sorting chute, and is operable to divert item to either side of sortation conveyor 34. Thus, each diverter can divert items to a selected one of two sequencing conveyors 44.

As best seen in FIG. 4, diverter 46 is preferably arranged above the upper surface of sortation conveyor 34, and comprises a plurality of brushes 48 arranged to sweep transversely across the upper surface of the sortation conveyor. Brushes 48 are mounted on an endless belt or chain 50, which is driven either clockwise or counterclockwise around an oval path defined by two end sprockets 52 by a reversible drive motor 54. By driving motor 54 so that it rotates in one direction, the brushes 48 can be made to sweep an item 56 to the left side of sortation conveyor 34 (as illustrated in FIG. 4), and by driving motor 54 so that it rotates in the opposite direction, the brushes can be made to sweep an item to the right side of sortation conveyor 34.

Although a single brush 48 is sufficient for diverter 46 to sweep an item off the sortation conveyor, three brushes, spaced apart by about one-third of the circumference of chain 50, are found to provide much more rapid diverter operation, which enables the throughput of sortation and sequencing system 10 to be much higher.

The diverter command signals to the drive motor 54 are generated by the SCS 20, in response to the item identification and encoder output signals. When the SCS 20 determines from those signals that an individual item is at the location along sortation conveyor 34 adjacent the sequencing conveyor corresponding to a particular order for which the item is intended, it sends a command signal to the appropriate diverter 46 to divert the item at the proper sequencing conveyor. The command signal preferably includes the encoder address at which the diverter will operate, and the direction in which the diverter 46 should push the item, i.e., either to the left or the right of the sortation conveyor 34. A representative situation is illustrated in FIG. 4, in which the diverter 46 is operated to sweep an item 56 to the left (as illustrated in the figure).

Once the item 56 is swept from the sortation conveyor 34 by diverter 46, it falls into one of the sorting chutes 42. Each sorting chute is associated with a single one of the plurality of sequencing conveyors 44. Thus, each chute is associated with an individual given order or group of orders, and all items swept into a given chute from any one of the sortation conveyors 34 comprise a single order or group of specific orders. However, the items which are diverted into a given chute, while all belonging to the same order or group of orders, are not necessarily in any particular sequence. The sequencing conveyors 44 receive the randomly arranged items from the sortation conveyors 34 and arrange the items in a desired sequence within the order or group of orders.

An individual sequencing conveyor 44 is illustrated in FIGS. 4 and 5. Sequencing conveyor 44 is mounted on a suitable frame 58, and is driven by a drive motor 60, a drive belt 62, and sprocket 64, in known manner. The motor, belt, and sprocket arrangement drives the sequencing conveyor 44 so that the upper half of the conveyor moves in a direction toward the sortation conveyors 34 when items are being placed into the sequencing conveyor 44 from the sortation conveyors 34. Thus, the sequencing conveyor 44 illustrated in FIGS. 4 and 5 moves in a clockwise direction during a fill cycle, while a sequencing conveyor on the opposite side of the sortation conveyors would be driven to move in a counterclockwise direction. Sequencing conveyor 44 comprises a plurality of panels 66 fixed at one end 70 to chain 68, which wraps around the sprockets 64 at each end of sequencing conveyor 44. Panels 66 move consistent with the chain 68 to which they are attached, and individual links in chain 68 are received in the spaces between the teeth on the sprockets 64, which provides the drive for the panels 66. At the free end of each panel 66 (i.e., the end opposite the end at which the panels are joined to endless belt 66), there is provided a perpendicular lip 72.

As will be appreciated, as the sequencing conveyor is driven by motors 60, the panels will be moved continuously in either the clockwise or counterclockwise direction, depending on which side of the sortation conveyors the sequencing conveyor is located. While the panels are moving along the top and bottom surfaces of the conveyors, the lip 72 of any given panel 66 will be in contact with the panel immediately in front of it, and the panel 66 will be in contact with the lip 72 of the panel immediately behind it. This forms a series of closed pockets 74 in which individual items 56 can be conveyed. As those skilled in the art will appreciate, the dimensions of the pockets 74 can be adjusted to hold articles of different sizes and shapes by altering the dimensions of the lips 72 and the spacing between the panels 66. Although the invention is broad enough to encompass different sizes and shapes of panels on a single sequencing conveyor, it is preferred that all of the panels on a given sequencing conveyor be the same size and shape.

Referring now to FIG. 4, as the panels 66 are conveyed around the sprocket 64 at the receiving end of sequencing conveyor 44, the panels will fan out as they move in the semicircular path around the sprocket 64. Thus, the pockets 74 will open and then close as they move around sprocket 64. While the pockets 74 are open, an individual item 56 may be placed in a pocket 74 when it is adjacent the discharge end of sorting chute 42. When an item is to be placed in a pocket 74 of sequencing conveyor 44, the sequencing conveyor is stopped at a location adjacent sorting chute 42 which affords an optimum entry capability of the item from chute 42 into pocket 74. Once in a pocket, the item will remain therein until the pocket and the item reach the discharge end of the sequencing conveyor shown in FIG. 5.

Once a pocket 74 and an item 56 in the pocket reach the discharge end of sequencing conveyor 44, the pocket 74 will begin to open as the panels move around sprocket 64. Opening the pocket 74 permits the item 56 in it to fall out as the panels round the sprocket. However, it is desired to control when an item 56 leaves a pocket and is discharged by sequencing conveyor 44. By controlling when an item is discharged, the items can be discharged in a desired, preselected sequence.

Figure 6:
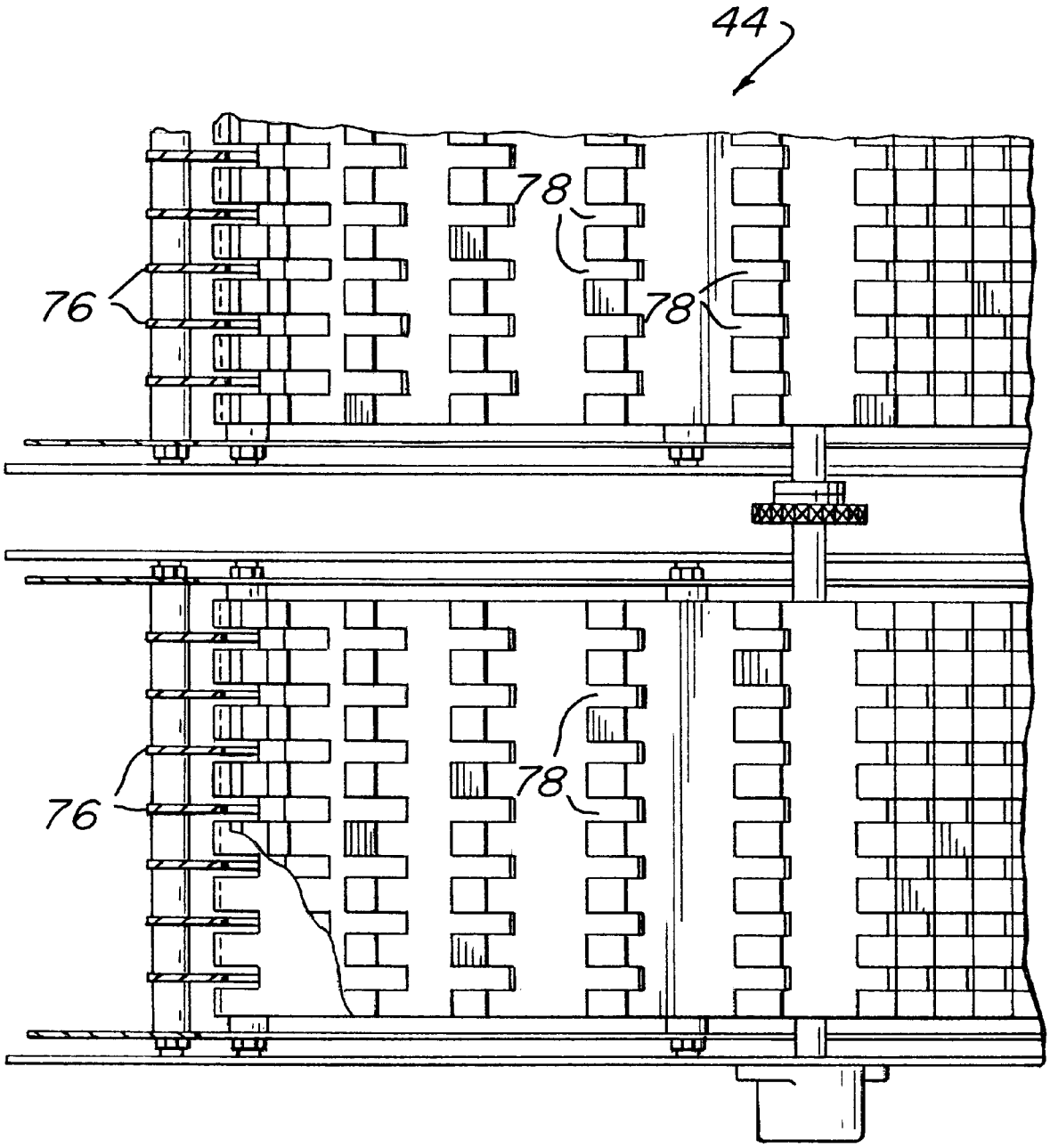
FIG. 6 is a top plan view, partially in section, showing the discharge end of the sequencing portion of the system according to the invention.

Thus, as panels 66 move around sprocket 64, items 56 are retained in their associated pockets 74 by an arrangement of rails 76. The rails 76 follow the curvature of the path the panels 66 follow as they round sprocket 64, and keep the items 56 from falling out of their associated pockets. To accommodate the rails as the panels 66 pass by them, the lips 72 may be provided with recesses 78 (see FIG. 6) through which the rails extend at the panels 66 move past. (Although a plurality of generally parallel rails is preferred, it is within the scope of the invention to use a continuous surface instead of rails.)

To permit an item 56 to be discharged by sequencing conveyor 44 when it is desired to do so, each rail 76 is provided with a pivotable section 80. Pivotable section 80 pivots about a rod or pin 82 under the action of an appropriate control device 84, such as a solenoid, a piston, or a crank arm. When it is desired to discharge an item 56 from sequencing conveyor 44, the control device 84 is commanded to cause the pivotable section 80 to pivot downward, to the position shown in phantom in FIG. 5. This creates a gap in the rails 76 through which an item 56 may fall, by gravity, out of its associated pocket. As it does so, it is discharged from sequencing conveyor 44 through discharge chute 86. From there, it may be placed in a shipping or other container for the particular order associated with that sequencing conveyor for shipment or further processing of the order. If it is desired not to discharge an item 56 as it passes over rails 76, pivotable section 80 remains in place until a subsequent pass of the item 56.

It will be appreciated that, by controlling when items are discharged from sequencing conveyor 44, the sequence in which they are discharged can be controlled. Thus, the items in a particular sequencing conveyor can be not only grouped together in a given order, but arranged in a preselected sequence within that order.

Figure 8:
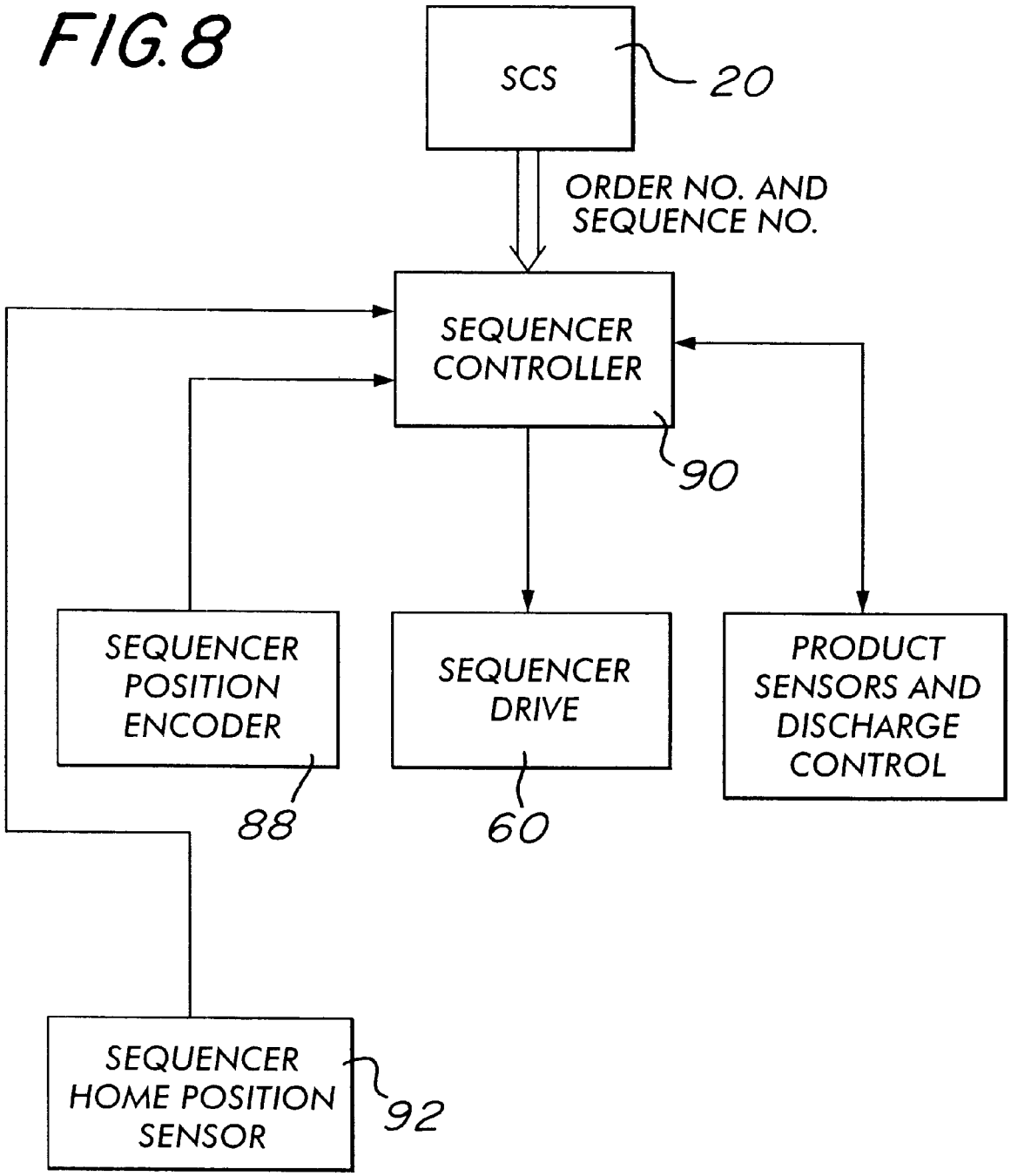
FIG. 8 is a block diagram, greatly simplified, showing the operation of the sequencer control system to control the operation of the sequencing portion of the system according to the invention.

The operation of the sequencer to discharge items in a preselected sequence is illustrated in block diagram form in FIG. 8. The position of the sequencer conveyor 44 is sensed by a shaft encoder 88 associated with the sequencer conveyor drive motor 60, and the output signal from the shaft encoder 88 is sent to sequencer controller 90. A sequencer home position sensor 92 (illustrated in FIG. 4) detects when the sequencer is in a known reference, or home, position and the output signal from the home position sensor 92 is also sent to sequencer controller 90. Sensors 94 at the inlet end and sensors 96 at the discharge end of sequencer conveyor 44 sense whether an item is present in a pocket 74, and the output signals from sensors 94 and 96 are sent to sequencer controller 90.

Each pocket 74 of sequencer conveyor 44 is assigned a location in a lookup table in sequencer controller 90. The table location stores the order number and sequence number sent to sequencer controller 90 from SCS 20 in the appropriate table location. SCS 20 sends the identity of individual items placed in pockets 74 to sequencer controller 90. As sequencer conveyor 44 is driven by motor 60, the output signals from the sequencer position encoder 88 and the home position sensor 92 are used to logically track each pocket. Motor 60 drives sequencer conveyor 44 is both the clockwise and counterclockwise directions, and the particular direction is determined by the location of the pocket in which the next required item is located relative to the discharge end of sequencer conveyor 44. When the sequencer controller 90 determines from the sensor inputs and the locations stored in the lookup table that a pocket containing the next item in the desired sequence is at the discharge location, sequencer controller 90 sends a discharge control signal to discharge control device 84. The discharge control signal actuates discharge control device 84 and causes pivotable section 80 to pivot downward and discharge the item through chute 86.

The present invention may be embodied in other specific forms without departing from the spirit or essential attributes thereof and, accordingly, reference should be made to the appended claims, rather than to the foregoing specification, as indicating the scope of the invention.

We claim:

1. A sortation and sequencing system for sorting a plurality of different items into discrete orders and putting said items into a predetermined sequence within each discrete order, comprising an induction station for accepting items in random succession, a sensor at said induction station for sensing an identifying characteristic unique to each item and for generating tracking signals uniquely corresponding to the items for tracking the items through the system, a controller for receiving said tracking signals and generating sort command and sequence command signals in part responsive to said tracking signals, a sorter for receiving said items from said induction station and for directing individual items to selected ones of a plurality of sort locations, each sort location corresponding to an individual order, in response to sort command signals from said controller, and a sequencer associated with each sort location for receiving sorted items from said sorter and for discharging said items in a preselected sequence at a discharge location in response to said sequence control signals.

2. A sortation and sequencing system as in claim 1, wherein said induction station includes at least one conveyor for conveying items to said sorter.

3. A sortation and sequencing system as in claim 2, wherein said induction station includes a scale associated with the conveyor for weighing items and generating weight signals representative of the weights of items as items are conveyed to said sorter.

4. A sortation and sequencing system as in claim 1, wherein said sensor comprises a bar code reader for reading bar codes on items.

5. A sortation and sequencing system as in claim 1, further comprising a detector for detecting the presence of an item at the induction station and generating a signal representing the presence of said item.

6. A sortation and sequencing system as in claim 1, wherein said sorter comprises at least one conveyor having associated therewith an item diverter at each of said sort locations for directing items to selected ones of said sort locations.

7. A sortation and sequencing system as in claim 1, wherein said sorter comprises a plurality of conveyors arranged in a vertical sequence, each conveyor having associated therewith an item diverter at each of said sort locations for directing items to selected ones of said sort locations.

8. A sortation and sequencing system as in claim 1, wherein said sequencer comprises a plurality of item-receiving receptacles for receiving individual ones of said sorted items from said sorter.

9. A sortation and sequencing system for sorting a plurality of different items into discrete orders and putting said items into a predetermined sequence within each discrete order, comprising an induction station for accepting items in random succession, said induction station including at least one conveyor for conveying items to said sorter, a scale associated with the conveyor for weighing items and generating weight signals representative of the weights of items as items are conveyed to said sorter, a first detector for detecting the presence of an item on the conveyor and generating a signal representing the presence of said item, and a second detector for detecting the movement of said item past an exit point relative to said conveyor and generating a signal representative of said movement, a bar code reader at said induction station for reading bar codes on items unique to each item and for generating tracking signals uniquely corresponding to the items for tracking the items through the system, a controller for receiving said signals from said first and second detectors and said tracking signals and generating sort command and sequence command signals in part responsive to said signals received by said controller, a sorter for receiving said items from said induction station and for directing individual items to selected ones of a plurality of sort locations, said sorter having at least one conveyor having associated therewith an item diverter at each of said sort locations for directing items to selected ones of said sort locations, each sort location corresponding to an individual order, in response to sort command signals from said controller, and a sequencer associated with each sort location for receiving sorted items from said sorter and for discharging said items in a preselected sequence at a discharge location in response to said sequence control signals, said sequencer comprising a plurality of item-receiving receptacles for receiving individual ones of said sorted items from said sorter, said receptacles being arranged for movement of said receptacles toward and away from said sorter on an endless belt and being openable and closeable in response to said movement.

10. A method of sorting a plurality of different, items into discrete orders and putting said items into a predetermined sequence within each discrete order, comprising the steps of accepting items in random succession at an induction station, sensing at said induction station an identifying characteristic unique to each item and generating tracking signals uniquely corresponding to the items for tracking the items through the system, generating sort command and sequence command signals in part responsive to said tracking signals, conveying said items from said induction station to a sorter for directing individual items to selected ones of a plurality of sort locations, each sort location corresponding to an individual order, in response to sort command signals from said controller, and conveying sorted items from said sorter into a sequencer associated with each sort location and for discharging said items in a preselected sequence at a discharge location in response to said sequence control signals.

11. A sortation and sequencing system for sorting a plurality of different items into discrete orders and putting said items into a preselected sequence within each discrete order, comprising an order picking installation for receiving discrete orders, each order specifying a plurality of items, picking from an inventory items specified in a plurality of said orders, and dispensing said items in arbitrary succession, an induction station for receiving the items in arbitrary succession from the order picking installation, a sensor at said induction station for sensing an identifying characteristic unique to each item of said plurality of items and for generating tracking signals uniquely corresponding to the items for tracking the items through the system, a controller for receiving said tracking signals and generating sort command and sequence command signals in part responsive to said tracking signals, a sorter for receiving said items from said induction station and for directing individual items to selected ones of a plurality of sort locations, each sort location corresponding to an individual order, in response to sort command signals from said controller, and a sequencer associated with each sort location for receiving sorted items from said sorter and for discharging said items in a preselected sequence at a discharge location in response to said sequence control signals.

12. A sortation and sequencing system for sorting a plurality of different items into discrete orders and putting said items into a desired sequence within each discrete order, comprising an induction station for accepting items in random succession, a sensor at said induction station for sensing an identifying characteristic unique to each item and for generating tracking signals uniquely corresponding to the items for tracking the items through the system, a controller for receiving said tracking signals and generating sort command and sequence command signals in part responsive to said tracking signals, a sorter for receiving said items from said induction station and for directing each item to a selected one of a plurality of sort locations, each sort location corresponding to an individual order, in response to sort command signals from said controller, and a sequencer associated with each sort location for receiving sorted items from said sorter and for discharging said items in a preselected sequence at a discharge location in response to said sequence control signals, the sequencer comprising a plurality of item-receiving receptacles, means for directing each received item into an arbitrarily assigned one of said receptacles, and means for removing the items from the receptacles in the desired sequence.

13. A sortation and sequencing system for sorting a plurality of different items into discrete orders and putting said items into a preselected sequence within each discrete order, comprising an induction station for accepting items in random succession, a sensor at said induction station for sensing an identifying characteristic unique to each item and for generating tracking signals uniquely corresponding to the items for tracking the items through the system, a controller for receiving said tracking signals and generating sort command and sequence command signals in part responsive to said tracking signals, a sorter for receiving said items from said induction station and for directing individual items to selected ones of a plurality of sort locations, each sort location corresponding to an individual order, in response to sort command signals from said controller, and a sequencer associated with each sort location for receiving sorted items from said sorter and for discharging said items in a preselected sequence at a discharge location in response to said sequence control signals, wherein said induction station includes at least one conveyor for conveying items to said sorter, and further comprises a scale associated with the conveyor for weighing items and generating weight signals representative of the weights of items as items are conveyed to said sorter, a first detector for detecting the presence of an item on the conveyor and generating a signal representing the presence of said item, and a second detector for detecting the movement of said item past an exit point relative to said conveyor and generating a signal representative of said movement, and wherein said controller receives said signals from said first and second detectors.

14. A sortation and sequencing system for sorting a plurality of different items into discrete orders and putting said items into a preselected sequence within each discrete order, comprising an induction station for accepting items in random succession, a sensor at said induction station for sensing an identifying characteristic unique to each item and for generating tracking signals uniquely corresponding to the items for tracking the items through the system, a controller for receiving said tracking signals and generating sort command and sequence command signals in part responsive to said tracking signals, a sorter for receiving said items from said induction station and for directing individual items to selected ones of a plurality of sort locations, each sort location corresponding to an individual order, in response to sort command signals from said controller, and a sequencer associated with each sort location for receiving sorted items from said sorter and for discharging said items in a preselected sequence at a discharge location in response to said sequence control signals, wherein said sequencer comprises a plurality of item-receiving receptacles for receiving individual ones of said sorted items from said sorter, and said receptacles are arranged for movement toward and away from said sorter on an endless belt and are openable and closeable in response to said movement.

* * * * *